US005842620A

United States Patent [19]

Koudakis

[11] Patent Number: 5,842,620

[45] Date of Patent: Dec. 1, 1998

[54] BELT-MOUNTED TOOL HOLDER DEVICE

[76] Inventor: Stavros A. Koudakis, 1 Grant Ct., Hicksville, N.Y. 11801

[21] Appl. No.: 880,816

[22] Filed: Jun. 24, 1997

[51] Int. Cl.[6] ..... E04G 21/20

[52] U.S. Cl. ..... 224/673; 224/44.5; 224/678; 224/270; 224/904

[58] Field of Search ..... 224/671, 673, 224/674, 678, 679, 251, 270, 907, 904, 44.5

[56] References Cited

U.S. PATENT DOCUMENTS

| | | | |
|---|---|---|---|
| 2,068,054 | 1/1937 | Haislip . | |
| 2,576,624 | 11/1951 | Miller | 248/42 |
| 2,781,958 | 2/1957 | Lewandowski . | |
| 2,954,909 | 10/1960 | Miller et al. . | |
| 3,009,612 | 11/1961 | Fischett | 224/907 |
| 3,228,577 | 1/1966 | Croft | 224/553 |
| 3,874,573 | 4/1975 | Fruscella et al. . | |
| 4,372,468 | 2/1983 | Harvey | 224/904 |
| 4,457,462 | 7/1984 | Taormina | 224/269 |
| 4,540,943 | 9/1985 | Akers | 224/678 X |
| 4,638,530 | 1/1987 | Perry | 24/3 |
| 5,044,109 | 9/1991 | Fast | 43/21.2 |
| 5,052,603 | 10/1991 | Spina | 224/270 |
| 5,232,137 | 8/1993 | Devine | 224/251 X |
| 5,540,368 | 7/1996 | Oliva | 224/271 |
| 5,593,074 | 1/1997 | Matthews | 224/251 |

*Primary Examiner*—Renee S. Luebke

*Attorney, Agent, or Firm*—John K. Flanagan; John R. Flanagan; Flanagan & Flanagan

[57] ABSTRACT

A belt-mounted tool holder device includes a support plate defining a pair of spaced apart slots for receiving therethrough a belt of a wearer, a holder member fixedly attached to the support plate and extending outwardly therefrom, and a cup attached to an outer end of the holder member for receiving a portion of a tool therein. An inner end of the holder member is fixedly attached to one of the opposite sides of the support plate below the spaced apart slots defined by the support plate. The holder member extends outwardly from the support plate at an angle lying within a range of from about 15° above to about 15° below a line extending perpendicular to the support plate. The cup is attached to the outer end of the holder member and has a bottom wall and an annular sidewall attached to a periphery of the bottom wall and extending upwardly therefrom. The annular sidewall defines an interior cavity and a top opening for receiving the portion of the tool into the interior cavity of the cup.

20 Claims, 1 Drawing Sheet

BELT-MOUNTED TOOL HOLDER DEVICE

BACKGROUND OF THE INVENTION

1. Field of the Invention

The present invention generally relates to devices for holding tools and, more particularly, is concerned with a belt-mounted holder device for holding a tool, such as one used to support construction material, for instance, caulking material and the like.

2. Description of the Prior Art

Construction workers frequently do not have enough hands available for many of the tasks they are required to perform on the job. For this reason, it is generally desirable for all workers to have as many hands free as possible. One way to achieve this result is by providing a means other than hands to retain tools and the like in close proximity to the worker such that the tool remains readily accessible. Various devices have been developed over the years for supporting tools and the like on the worker.

Representative examples of prior art devices for holding tools and the like to free user's hands are disclosed in U.S. Pat. No. 2,068,054 to Haislip, U.S. Pat. No. 2,576,624 to Miller, U.S. Pat. No. 2,781,958 to Lewandowski, U.S. Pat. No. 2,954,909 to Miller et al., U.S. Pat. No. 3,874,573 to Fruscella et al., U.S. Pat. No. 4,457,462 to Taormina, U.S. Pat. No. 4,638,530 to Perry, U.S. Pat. No. 5,044,109 to Fast, U.S. Pat. No. 5,540,368 to Oliva and U.S. Pat. No. 5,593,074 to Matthews. While these prior art devices appear to be satisfactory in use for the specific purposes for which they were designed, none of them would seem to provide a simple and yet effective solution for construction workers.

Consequently, a need still exists for a device which provides construction workers with an optimum solution to the aforementioned problem without introducing any new problems in place thereof.

SUMMARY OF THE INVENTION

The present invention provides a belt-mounted tool holder device designed to satisfy the aforementioned need. The belt-mounted tool holder device of the present invention enables a construction worker to carry a tool at his or her side. The belt-mounted tool holder device frees both hands of the construction worker and at the same time provides easy access to the tool. The belt-mounted tool holder device is a simple and yet effective solution for supporting a tool on the worker.

Accordingly, the present invention is directed to a belt-mounted tool holder device which comprises: (a) a support body; (b) means for removably securing the support body to a belt of a wearer; (c) a holder member fixedly attached at an inner end to the support body and extending outwardly therefrom to an opposite outer end; and (d) a cup attached to the outer end of the holder member and defining an interior cavity for receiving a portion of a tool therein. The support body, holder member and cup can each be made of a substantially rigid material, such as a molded plastic material, and can have an integral one-piece construction, although not necessarily so.

The support body preferably is a rigid plate having a substantially flat (meaning planar or slightly curved) configuration with opposite sides and being of substantially rectangular shape. The securing means preferably is an upper portion of the support plate defining a pair of spaced apart slots disposed above the inner end of the holder member. The slots have vertical lengths longer than their horizontal widths to provide configurations adapted to receive the belt of the wearer.

The holder member preferably is a rigid strip of substantially rectangular shape both in side elevation and cross-section and has opposite inner and outer ends. The strip preferably is substantially greater in length than in height and substantially greater in height than in thickness. Preferably, the holder member extends outwardly from the support plate at an angle lying within a range of from about 15° above to about 15° below a line extending perpendicular to the support plate. In one exemplary implementation, it has been found advantageous to dispose the holder member at an angle about 10° below the perpendicular line.

The cup preferably is preferably fixedly attached to the outer end of the holder member and has a bottom wall and an annular sidewall attached to a periphery of the bottom wall. The sidewall extends upwardly from the periphery of the bottom wall and defines a top opening for receiving the portion of the tool in the interior cavity of the cup.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
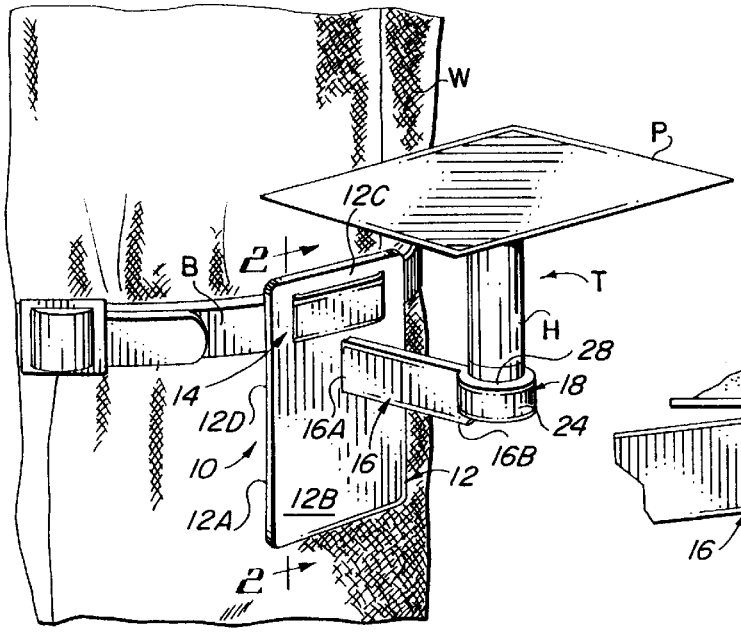
FIG. 1 is a perspective front elevational view of a belt-mounted tool holder device of the present invention supported on a belt of a user.

Referring to the drawings and particularly to FIGS. 1 to 4, there is illustrated a belt-mounted tool holder device, generally designated 10, of the present invention. Basically, the belt-mounted tool holder device 10 includes a support body 12, means 14 for securing the support plate 12 to a belt B of a wearer W, an elongated holder member 16 fixedly attached to the support plate 12 and extending outwardly therefrom, and a cup 18 attached to the holder member 16 for receiving a portion of a tool T therein. The plate 12, holder member 16 and cup 18 are preferably each comprised of a substantially rigid material, either metal or plastic. Also, preferably these components have an integral one-piece construction, although they can be separately made and then fastened together in any suitable manner.

The support body 12 of the device 10 is preferably a rigid plate 12 having a substantially flat (meaning planar or slightly curved) configuration with opposite sides 12A, 12B and being of substantially rectangular shape. The one side 12A of the support plate 12 is for contacting a portion of the body, such as the waist, of the wearer W. The other side 12B is for attachment to the holder member 16. The support plate 12 can have any suitable size.

The holder member 16 preferably is substantially rectangular in side elevation and cross-section and has opposite inner and outer ends 16A, 16B. The inner end 16A of the holder member 16 is rigidly attached to the outer side 12B of the support plate 12 while the outer end 16B of the holder member 16 is disposed outwardly from the support plate 12. The holder member 16 preferably is fixedly attached to the outer side 12B at a point slightly above the center of the plate 12, but may be attached to the side 12B at any other suitable location.

The securing means 14 preferably is an upper portion 12C of the support plate 12 wherein a pair of spaced apart slots 20 are disposed above and on opposite sides of the inner end 16A of the holder member 16. Each slot 20 has a vertical length L longer than its horizontal width W to provide a configuration adapted to receive the belt B of the wearer W. The slots 20 are spaced apart from one another such that each slot 20 is generally halfway between a peripheral edge 12D of the base plate 12 and an imaginary vertical line V dividing the base plate 12 into two equal portions.

Figure 3:
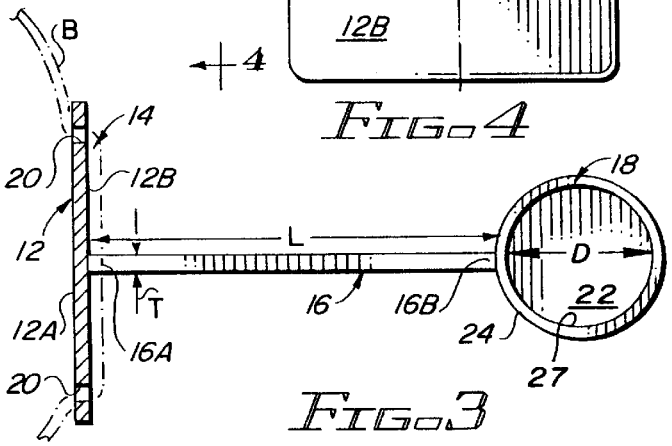
FIG. 3 is a top plan view of the belt-mounted tool holder device as seen along line 3—3 of FIG. 2.

The cup 18 preferably is fixedly attached to the outer end 16B of the holder member 16 and has a generally flat bottom wall 22 and an annular shaped, continuous sidewall 24 attached to a periphery 26 of the flat bottom wall 22. The annular sidewall 24 extends upwardly from the periphery 26 of the flat bottom wall 22. As seen in FIGS. 1 and 3, the annular sidewall 24 has an interior cavity 27 of a diameter D and a top opening 28 for receiving the portion of the tool T in the cup 18. The cup 18 can have any suitable size. The cup 18 can also have any suitable shape other than the preferred configuration.

Figure 5:
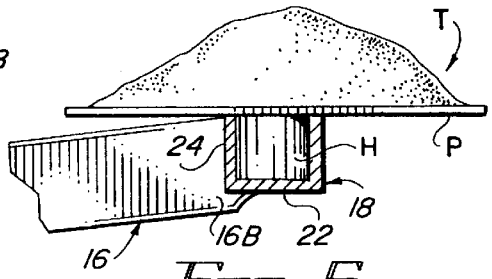
FIG. 5 is a fragmentary side elevational view of a form of the device slighly modified from that shown in FIG. 2.
Figure 2:
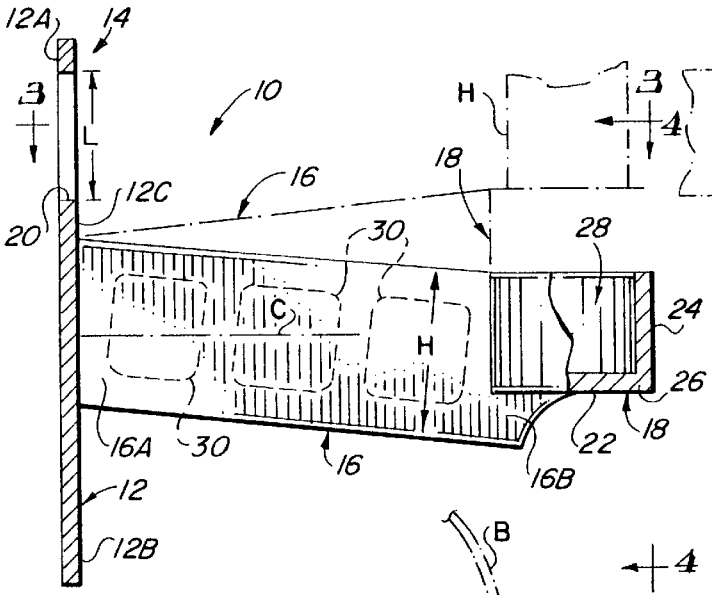
FIG. 2 is a vertical sectional view of the belt-mounted tool holder device taken along line 2—2 of FIG. 1.
Figure 4:
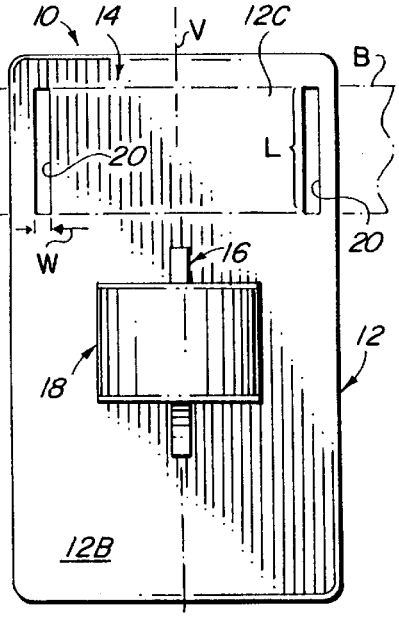
FIG. 4 is a front elevational view of the belt-mounted tool holder device as seen along line 4—4 of FIG. 2.

Furthermore, the holder member 16 preferably is a rigid strip 16 of substantially rectangular shape both in side elevation and cross-section. The holder member 16 can have holes 30 for reinforcement purposes. The strip 16 preferably is substantially greater in length L than in height H and substantially greater in height H than in thickness T. Preferably, the holder member 16 extends outwardly from the support plate 12 at an angle lying within a range of from about 15° above to about 15° below a line C extending perpendicular to the outer surface 12B of the support plate 12. In one exemplary implementation, it has been found advantageous to dispose the holder member 16 at an angle about 10° below the perpendicular line C. Alternatively, the holder member 16 is shown in FIG. 5 at an angle of about 10° above the line C. The holder member 16 can have any suitable length L for spacing the cup 18 any suitable distance away from the wearer. As can be readily seen in FIGS. 2 and 3, the length L of the strip 16 extending from the support plate 12 to the cup 18 is, particularly, at least twice the diameter D of the interior cavity 27 of the cup 18 to thereby displace the cup 18 a sufficient distance away from the wearer so as to allow adequate space above the strip 16 between the support plate 12 and cup 18 for any number of different tools T to be inserted within and overlie the cup 18 and extend through the space above the strip 16 between the cup 18 and support plate 12. By way of example, the tool T shown in the drawings has a handle H and a flat platform P on which is placed a quantity of construction material, such as drywall caulking material.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A belt-mounted tool holder device, comprising:

(a) a support body;

(b) means for removably securing said support body to a belt of a wearer;

(c) a holder member having opposite inner and outer ends, said holder member being fixedly attached at said inner end to said support body and extending outwardly therefrom to said opposite outer end; and (d) a cup fixedly attached to said outer end of said holder member and defining an interior cavity having a diameter and for receiving a portion of a tool therein, said holder member having a length extending from said support body to said cup at least twice said diameter of said interior cavity of said cup to thereby displace said cup a sufficient distance away from the wearer so as to allow adequate space above the holder member between said support body and cup for any number of different tools to be inserted within and overlie said cup and extend through said space above said holder member between said cup and support plate.

2. The device of claim 1 wherein said support body is a plate having a substantially flat shape and a pair of opposite sides, said holder member at said inner end being fixedly attached to and extending outwardly from one of said sides of said support plate.

3. The device of claim 2 wherein said securing means is an upper portion of said support plate defining a pair of spaced apart slots disposed above said inner end of said holder member, said slots having shapes adapted to receive the belt of the wearer.

4. The device of claim 3 wherein each of said slots has a vertical length greater than a horizontal width.

5. The device of claim 1 wherein said holder member is a rigid strip of substantially rectangular shape both in side elevation and cross-section.

6. The device of claim 1 wherein said holder is a rigid strip being substantially greater in length than in height and substantially greater in height than in thickness.

7. The device of claim 1 wherein said holder member extends outwardly from said support body at an angle lying within a range of from about 15° above to about 15° below a line extending perpendicular to said support body.

8. The device of claim 7 wherein said angle is equal to about 10° below said line.

9. The device of claim 1 wherein said cup has a bottom wall and an annular sidewall attached to a periphery of said bottom wall and extending upwardly therefrom, said annular sidewall defining said interior cavity and a top opening to said interior cavity for receiving a portion of the tool within said cup.

10. A belt-mounted tool holder device, comprising:

(a) a support plate having a substantially flat shape, a pair of opposite sides and an upper portion defining a pair of spaced apart slots for receiving therethrough a belt of a wearer;

(b) a holder member having opposite inner and outer ends, said inner end being fixedly attached to one of said opposite sides of said support plate below said pair of spaced apart slots, said holder member extending outwardly from said support plate to said opposite outer end; and (c) a cup fixedly attached to said outer end of said holder member and defining an interior cavity having a diameter and for receiving a portion of a tool therein, said holder member having a length extending from said support body to said cup at least twice said diameter of said interior cavity of said cup to thereby displace said cup a sufficient distance away from the wearer so as to allow adequate space above said holder member between said support plate and cup for any number of different tools to be inserted within and overlie said cup and extend through said space above said holder member between said cup and support plate.

11. The device of claim 10 wherein said holder member is a rigid strip of substantially rectangular shape both in side elevation and cross-section.

12. The device of claim 10 wherein said holder is a rigid strip being substantially greater in length than in height and substantially greater in height than in thickness.

13. The device of claim 10 wherein said holder member extends outwardly from said support plate at an angle lying within a range of from about 15° above to about 15° below a line extending perpendicular to said support plate.

14. The device of claim 13 wherein said angle is equal to about 10° below said line.

15. The device of claim 10 wherein said cup has a bottom wall and an annular sidewall attached to a periphery of said bottom wall and extending upwardly therefrom, said annular sidewall defining said interior cavity and a top opening to said interior cavity for receiving a portion of the tool within said cup.

16. The device of claim 15 wherein said holder member is a rigid strip of substantially rectangular shape both in side elevation and cross-section.

17. The device of claim 15 wherein said holder is a rigid strip being substantially greater in length than in height and substantially greater in height than in thickness.

18. The device of claim 15 wherein said holder member extends outwardly from said support plate at an angle lying within a range of from about 15° above to about 15° below a line extending perpendicular to said support plate.

19. The device of claim 18 wherein said angle is equal to about 10° below said line.

20. The device of claim 15 wherein each of said slots in said support plate has a vertical length greater than a horizontal width.

* * * * *